US010107066B2

(12) United States Patent
Milh et al.

(10) Patent No.: US 10,107,066 B2
(45) Date of Patent: Oct. 23, 2018

(54) ANTI-CREEP RINGS AND CONFIGURATIONS FOR SINGLE PACKERS

(71) Applicant: Schlumberger Technology Corporation, Sugar Land, TX (US)

(72) Inventors: Patrice Milh, Abbeville (FR); Pierre-Yves Corre, Eu (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 201 days.

(21) Appl. No.: 14/106,467

(22) Filed: Dec. 13, 2013

(65) Prior Publication Data

US 2015/0167420 A1 Jun. 18, 2015

(51) Int. Cl.
*E21B 33/128* (2006.01)
*E21B 33/12* (2006.01)

(52) U.S. Cl.
CPC ..... *E21B 33/128* (2013.01); *E21B 33/1216* (2013.01)

(58) Field of Classification Search
CPC .. E21B 33/1216; E21B 33/128; E21B 33/127; E21B 33/1277
See application file for complete search history.

(56) References Cited

U.S. PATENT DOCUMENTS 3,191,682 A * 6/1965 Cochran ..... E21B 33/122 166/120
4,452,463 A * 6/1984 Buckner ..... E21B 33/1216 166/196
4,696,502 A * 9/1987 Desai ..... E21B 29/00 166/98
5,353,871 A 10/1994 Eslinger et al.
5,390,738 A 2/1995 Eslinger et al.
5,439,053 A 8/1995 Eslinger et al.
5,507,341 A 4/1996 Eslinger et al.
5,613,555 A 3/1997 Sorem et al.
7,510,015 B2 3/2009 Corre et al.
7,699,124 B2 * 4/2010 Corre ..... E21B 49/10 166/264
7,703,542 B2 * 4/2010 O'Connor ..... E21B 43/103 166/207
7,730,941 B2 * 6/2010 Abarca ..... E21B 33/1208 166/195

(Continued)

FOREIGN PATENT DOCUMENTS

WO 2009147564 A1 12/2009

OTHER PUBLICATIONS

Corre, et al., "Single Packer With a Sealing Layer Shape Enhanced for Fluid Performance", U.S. Appl. No. 13/666,411, filed Nov. 1, 2012, 16 pages.

(Continued)

*Primary Examiner* — David J Bagnell
*Assistant Examiner* — Manuel C Portocarrero

(57) ABSTRACT

In one example a tool is provided, having a body configured to expand from a first diameter to a second diameter, an outer covering for the body, the outer surface having at least one inlet to accept fluid through the outer covering into the body, the outer covering to outer proximate ends and at least two anti-creep rings abutting the outer covering at each of the outer proximate ends, wherein the anti-creep rings constrain the outer covering from movement.

10 Claims, 2 Drawing Sheets

(56) References Cited

U.S. PATENT DOCUMENTS

| | | | | |
|---|---|---|---|---|
| 7,823,636 | B2 | 11/2010 | Lucas | |
| 7,874,356 | B2 | 1/2011 | Corre et al. | |
| 8,113,293 | B2 | 2/2012 | Corre | |
| 8,413,717 | B2 | 4/2013 | Corre et al. | |
| 2005/0028974 | A1* | 2/2005 | Moody | E21B 49/081 166/264 |
| 2007/0144734 | A1 | 6/2007 | Xu et al. | |
| 2010/0071898 | A1* | 3/2010 | Corre | E21B 33/12 166/264 |
| 2010/0294516 | A1 | 11/2010 | Corre et al. | |
| 2013/0306309 | A1 | 11/2013 | Corre et al. | |
| 2014/0096979 | A1 | 4/2014 | Corre et al. | |

OTHER PUBLICATIONS

International Search Report and Written Opinion issued in PCT/US2014/069965 dated Apr. 3, 2015, 13 pages.

* cited by examiner

ANTI-CREEP RINGS AND CONFIGURATIONS FOR SINGLE PACKERS

CROSS-REFERENCE TO RELATED APPLICATIONS

None.

FIELD OF THE INVENTION

Aspects relate to downhole drilling apparatus and methods. More specifically, aspects relate to apparatus to prevent creep of materials in single packers used in downhole drilling and single packers that incorporate apparatus to limit movement of outer coverings for the single packers.

BACKGROUND INFORMATION

Testing formation fluids in downhole conditions can be a challenging endeavor that presents many problems for engineers, drillers and scientists. To aid in the testing of such formation fluids, different apparatus may be used to accomplish the testing, including probes and single packer apparatus. Single packer apparatus have many advantages compared to standard testing devices. Single packer apparatus may be used to separate different segments of the wellbore so testing may be performed at a variety of pressures, for example.

In order to separate the different segments of a wellbore, the single packer device is positioned downhole at a desired elevation. The single packer, during placement, is generally in a minimum diameter configuration to allow the single packer to be fit and moved within the wellbore. Once the single packer is at the desired elevation, the single packer is expanded such that the outer diameter of the single packer contacts the inner diameter of the wellbore. The expansion may occur, for example, through actuation of an internal mandrel.

Expansion of the single packer can lead to significant problems, due to many issues. Environmental issues can cause stresses on different sections of the single packer system and thus, it would be desirable to eliminate such stresses.

The increase in diameter of the single packer system can cause the outer covering of the single packer to undergo significant stresses. A potential failure of the outer covering can compromise not only sampling efficiency, but also safety of the single packer as the outer covering is used as a bearing surface.

Currently, there is no protection from potential failure of the outer covering of a single packer, especially at the anterior ends of the single packer. Such ends are prone to over expansion as the single packer system ends have stress concentrations at the ends of the configurations.

SUMMARY

The following summary is but an example and should not be considered to limit the aspects described and claimed. In one example embodiment, a tool is provided having a body configured to expand from a first diameter to a second diameter, an outer covering for the body, the outer surface having at least one inlet to accept fluid through the outer covering into the body, the outer covering at outer proximate ends and at least two anti-creep rings abutting the outer covering at each of the outer proximate ends, wherein the anti-creep rings constrain the outer covering from movement.

In another example embodiment, a method is provided. In the method for sampling a fluid, aspects provide for placing a tool in a wellbore, lowering the tool in the wellbore to a desired elevation and expanding a diameter of the tool to an expanded diameter such that at the expanded diameter, the tool abuts a formation surface, wherein during the expanding of the diameter of the tool, an outer covering is retained in a position by at least two anti-creep rings.

DETAILED DESCRIPTION

Figure 1:
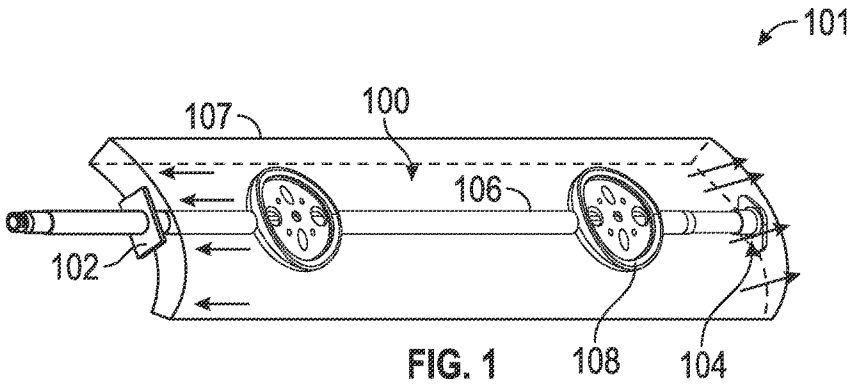
FIG. 1 is a perspective view of an inner section of a single packer with anti-creep rings installed.

Referring to FIG. 1, a perspective view of an exterior section 100 of a single packer 101 is provided. Some sections of the exterior section 100 as well as interior components have been eliminated for ease of illustration. The exterior section 100 is configured with a first anti-creep ring 102 and a second anti-creep ring 104. The exterior section 100 is retained on respective ends by the first anti-creep ring 102 and the second anti-creep ring 104. While the rubber bladder 106 has an opening for two sample inlets 108, other configurations may be used, including guard inlets and combinations of sample and guard inlets.

The first anti-creep ring 102 and the second anti-creep ring 104 are positioned on respective ends of the exterior section 100 of the single packer 101. A flow line 106 is provided throughout the exterior section 100. The flow line 106 accepts flow from either a guard flow inlet or a sample flow inlet 108, multiple guard flow inlets, multiple sample flow inlets and/or combinations of such inlets. The flow line 106 may be segmented into different sections where guard flow is separated from sample flow.

As provided by the arrows, during expansion, the materials provided for use in the exterior section 100 expand. Without any retaining capability, the section 100 will continue to expand and eventually rupture. To prevent excessive expansion, the first anti-creep ring 102 and the second anti-creep ring 104 retain the section into a predefined limit.

The exterior section 100, in the illustrated embodiment, is made of a rubber material to allow for expansion and contraction. Expansion and contraction of the single packer 101 may be accomplished, for example, by a mandrel. Due to the expected service conditions of single packer systems, high pressure and temperature conditions, the rubber used for the exterior section 100 of the single packer 101 creeps. This behavior decreases the number of cycles that the packer 101 can achieve. In order to increase the packer service time capability, the first anti-creep ring 102 and the second anti-creep ring 104 are designed and welded at the end of the flow line 106. Due to the first anti-creep ring 102 and the second anti-creep ring 104 creeping behavior is stopped along the flowlines. The resulting anti-creep system ensures that the bonding interface between tubes and rubber are protected and packer resistance to wear is increased. Different anti-creep ring shapes may be used. In alternative configurations, the anti-creep rings may be mechanically connected and provided with a capability to slide over a predefined distance. Different anti-creep shapes are provided in FIGS. 2, 3 and 4. The drains 108 and the flow line 106 may be placed along an axis that is parallel to an outside edge 107 of the single packer 101.

Figure 3:
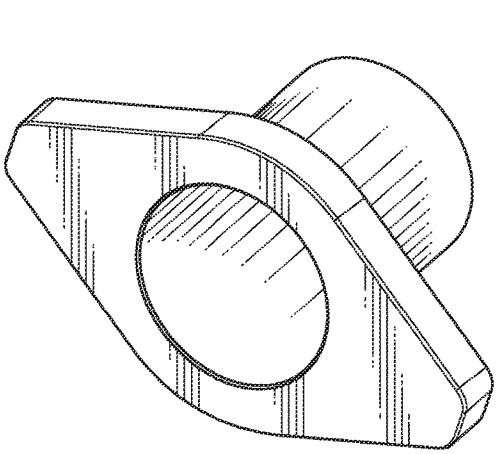
FIG. 3 is a second example embodiment of an anti-creep ring for a single packer.
Figure 4:
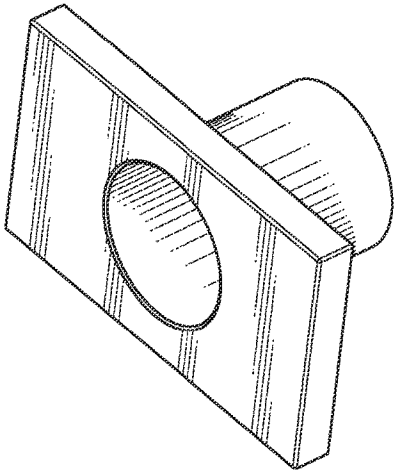
FIG. 4 is a third example embodiment of an anti-creep ring for a single packer.
Figure 2:
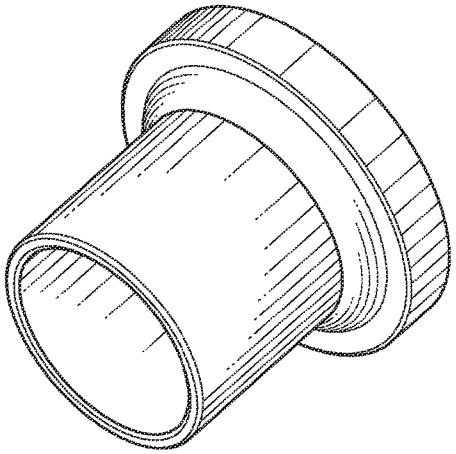
FIG. 2 is a first example embodiment of an anti-creep ring for a single packer.

Referring to FIG. 2, a round shape of an anti-creep ring is illustrated. Referring to FIG. 3, a rounded diamond shape anti-creep ring is illustrated. Referring to FIG. 4, a rectangular shape anti-creep ring is illustrated. Each of the types of anti-creep rings provided in FIG. 2, FIG. 3 or FIG. 4 may be used in a single packer system 101. The different shapes may be interchanged to provide different retention capabilities. Although the designs described are noted as "rings", the shapes that may be used may be varied. Ovals, boxes or other more complex shapes may be used.

The anti-creep rings provided in FIG. 2, FIG. 3 and FIG. 4 may be chosen to be made from various materials. In the illustrated embodiment, the materials are metallic to allow for a weld to the flow line 106 to occur.

Figure 5:
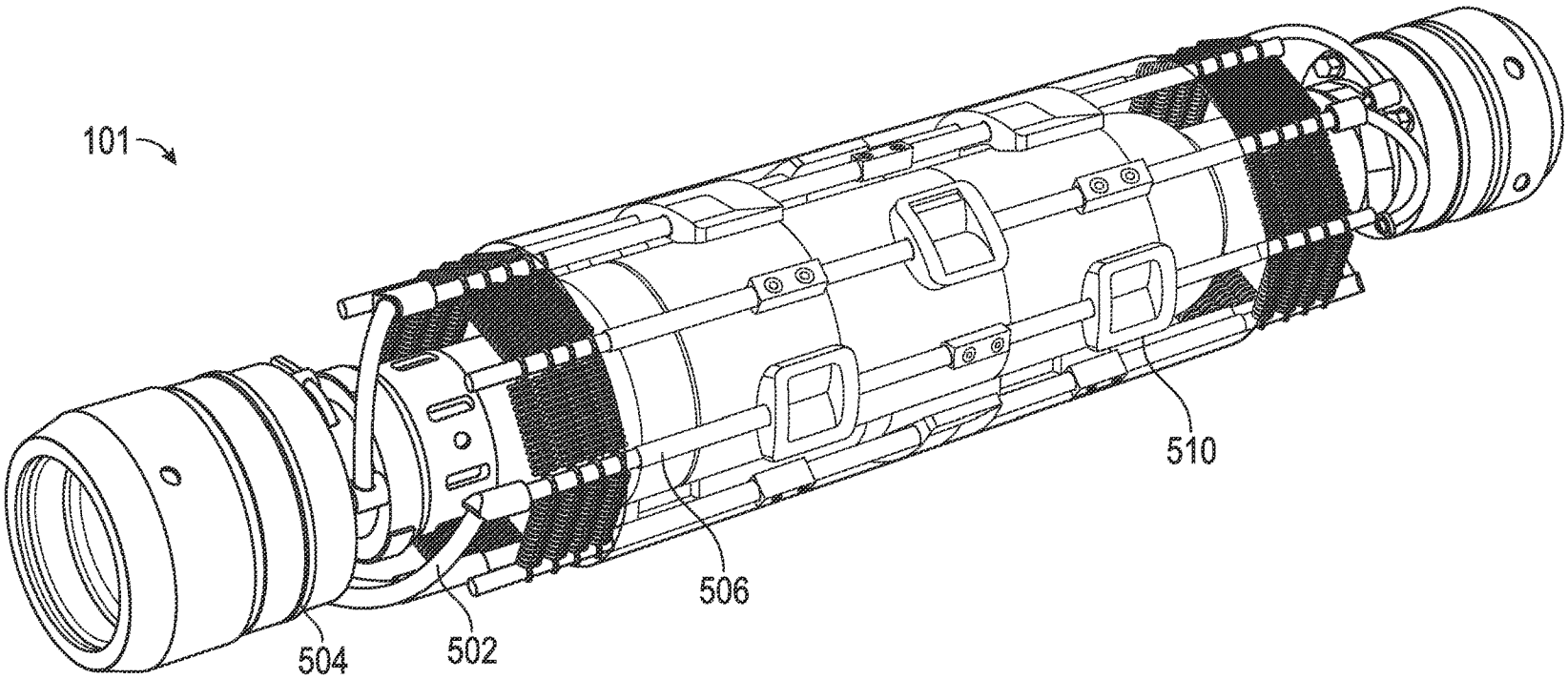
FIG. 5 is an overall assembly drawing of an assembled single packer system with anti-creep rings removed for ease of illustration.

Referring to FIG. 5, a perspective view of the single packer system 101 is illustrated. The single packer system 101 is placed downhole at a desired elevation in order to isolate a wellbore section or to sample fluid materials. The packer is transported through a conveyance to the desired downhole elevation. The conveyance may be a tractor, as a non-limiting embodiment. A mandrel is actuated such that the single packer system 101 is expanded from a first unexpanded diameter to a second expanded diameter. At the second expanded diameter, the drains 510 provided through the rubber layer/exterior section 100 are exposed to the surface of the formation. The drains 510 in FIG. 5 are placed over the inner section of the drains 108 of FIG. 1. Fluid may then be drawn into the single packer system 101. In another example embodiment, expansion may be performed through accepting well fluid inside the packer through the use of a pump.

When the single packer 101 is inflated at high temperatures, the outer rubber layer 101 is squeezed between the borehole and the inner packer structure, which may be an expandable body. The outer rubber layer 101 tends to creep towards the packer extremities. Due to this creep, a sheer stress occurs between the internal flowline and rubber at the bonding interface. Leaks may occur at this junction, compromising overall packer integrity.

During expansion of the single packer, rotating tubes allow for the movement of flow lines 506 resulting from the different diameters. The rotating tubes 502 are connected to end caps 504 that contain passages that allow for fluid transmitted to and from the single packer.

In one example embodiment, a tool is disclosed having a body configured to expand from a first diameter to a second diameter, an outer covering for the body, the outer surface having at least one inlet to accept fluid through the outer covering into the body, the outer covering to outer proximate ends, and at least two anti-creep rings abutting the outer covering at each of the outer proximate ends, wherein the at least two anti-creep rings constrain the outer covering from movement.

In another example embodiment, the tool may further comprise at least one flow line connected to the at least one inlet.

In another example embodiment, the tool may be provided wherein the at least two anti-creep rings are placed in on a same axis as an axis for the at least one flow line.

In another example embodiment, the tool may provide a construction wherein the at least two anti-creep rings are welded to the at least one flow line.

In another example embodiment, the tool may be constructed wherein the at least two anti-creep rings are at least one of circular, square, triangular, oval, diamond and rectangular in shape.

In a still further example embodiment the tool may further comprise at least mechanical ends, each of the mechanical ends configured to abut one end of the body, wherein each of the at least mechanical ends is configured connect to a downhole component.

In another example embodiment, the tool may be constructed wherein the at least one flow line is connected to at least one of the mechanical ends.

In another example embodiment, the tool may be constructed wherein the connection between the at least one flow is connected to the at least one of the mechanical ends through a swivel connection.

In a still further configuration, the tool may be constructed wherein the at least two anti-creep rings are made of a metal material.

In another example embodiment, a method for operating a tool is disclosed wherein the method comprises placing a tool in a wellbore, lowering the tool in the wellbore to a desired elevation, and expanding a diameter of the tool to an expanded diameter such that at the expanded diameter, the tool abuts a formation surface, wherein during the expanding of the diameter of the tool, an outer covering is retained in a position by at least two anti-creep rings.

The method may also further comprise sampling a fluid from the formation surface.

In another example embodiment, the method may further comprise transporting the fluid from the tool to a sample bottle.

In another example embodiment, the method may further comprise decreasing the diameter of the tool.

In another example embodiment, the method may further comprise removing the tool from the wellbore.

In another example embodiment, the tool may be constructed wherein the at least one inlet to accept fluid through the outer covering into the body is at least one sample inlet and at least one guard inlet, wherein flow from the at least one sample inlet is separate from the one at least one sample inlet.

While the aspects have been described with respect to a limited number of embodiments, those skilled in the art, having benefit of the disclosure, will appreciate that other embodiments can be devised which do not depart from the scope of the disclosure herein.

What is claimed is:

1. A downhole packer assembly, comprising:

an inflatable body configured to expand from a first diameter to a second diameter;

an outer covering for the inflatable body, the outer surface having at least one inlet to accept fluid through the outer covering into the inflatable body, the outer covering to extending to proximate ends;

an internal flow line embedded at least partially within the outer covering and fluidly coupled to the at least one inlet;

at least two mechanical ends, each of the mechanical ends configured to abut one end of the inflatable body, wherein the at least two mechanical ends comprise rotating tubes to allow for movement of the internal flow line resulting from expansion of the inflatable body from the first diameter to the second diameter, and the internal flow line is connected to at least one of the mechanical ends; and at least two anti-creep rings coupled to an exterior surface of the internal flow line, concentrically surrounding the internal flowline, abutting a portion of the outer covering at each of the proximate ends, disposed between the mechanical end and the outer covering, wherein the at least two anti-creep rings constrain the outer covering from movement.

2. The downhole packer assembly according to claim 1, wherein the at least two anti-creep rings are welded to the internal flow line, and the internal flow line moves as the inflatable body expands from the first diameter to the second diameter.

3. The downhole packer assembly according to claim 1, wherein the at least two anti-creep rings are at least one of circular, diamond, square, triangular and rectangular in shape for a portion of a body.

4. The downhole packer assembly according to claim 1, wherein each of the at least two mechanical ends is configured to connect to a downhole component.

5. The downhole packer assembly according to claim 1, wherein the at least two anti-creep rings are made of a metal material.

6. A method for operating a downhole packer assembly, comprising:

placing the downhole packer assembly in a wellbore;

lowering the downhole packer assembly in the wellbore to a desired elevation; and expanding a diameter of the downhole packer assembly to an expanded diameter such that at the expanded diameter, the downhole packer assembly abuts a formation surface, wherein during the expanding of the diameter of the downhole packer assembly, an outer covering for an inflatable body is retained in a position by at least two anti-creep rings, wherein the at least two anti-creep rings are coupled to an exterior surface of an internal flow line embedded at least partially within the outer covering and fluidly coupled to at least one inlet of the outer covering, the at least two anti-creep rings concentrically surround the internal flowline; and the at least two anti-creep rings are each disposed between a mechanical end and a portion of the outer covering.

7. The method according to claim 6, further comprising: sampling a fluid from the formation surface.

8. The method according to claim 7, further comprising: transporting the fluid from the downhole packer assembly to a sample bottle.

9. The method according to claim 8, further comprising: decreasing the diameter of the downhole packer assembly.

10. The method according to claim 9, further comprising: removing the downhole packer assembly from the wellbore.

* * * * *